United States Patent [19]

Shih

[11] Patent Number: 4,749,160

[45] Date of Patent: Jun. 7, 1988

[54] DOUBLE-CIRCLE UTILITY HOLDER

[76] Inventor: Parkson Shih, 2F., No. 29, Lane 245, Pa-Teh Road, Section 4, Teipei, Taiwan

[21] Appl. No.: 400

[22] Filed: Jan. 5, 1987

[51] Int. Cl.[4] ..... A47F 5/08

[52] U.S. Cl. ..... 248/316.1; 211/66; 248/223.4; 248/110

[58] Field of Search ..... 248/316.1, 315, 223.4, 248/360, 359 G, 359 R, 359.1, 113, 110, 111, 69, 307, 73; 211/65, 66

[56] References Cited

U.S. PATENT DOCUMENTS

| | | | |
|---|---|---|---|
| 562,566 | 6/1896 | Baynes | 248/113 X |
| 1,290,433 | 1/1919 | Walker | 248/359 G |
| 1,404,477 | 1/1922 | Pattberg et al. | 248/113 |
| 1,800,387 | 4/1931 | Greist | 248/307 |
| 1,913,105 | 6/1933 | Case et al. | 211/65 X |
| 3,515,284 | 6/1970 | Taylor | 248/307 X |

FOREIGN PATENT DOCUMENTS

| | | | |
|---|---|---|---|
| 564719 | 7/1960 | Belgium | 248/111 |
| 1202548 | 7/1959 | France | 248/359 G |

*Primary Examiner*—Ramon S. Britts
*Assistant Examiner*—Karen J. Chotkowski
*Attorney, Agent, or Firm*—Ladas & Parry

[57] ABSTRACT

The double-circle utility holder of the present invention, characterized primarily by its holder body being provided with two circular clamp portions, one at the top and the other at the bottom. In the center of each clamp portion there is a holding hole, with a frictional rubber washer attached thereto. The holder is made of elastic material. Owing to the elasticity of the material, the holder can be bent till the two clamp portions are almost in contact with each other so that the round rod handle of the tool can pass through the holes of the clamp portions, and when the bending force is released, the clamp portions hold the handle of the tool firmly by the friction exerted thereon by the rubber washer. In addition, the back of the holder is provided with a slider on an opening in its central portion so that the holder can slide on a rail or is individually secured to a wall.

8 Claims, 3 Drawing Sheets

DOUBLE-CIRCLE UTILITY HOLDER

DETAILED DESCRIPTION OF THE INVENTION

The invention is related to the structure of a holder, and in particular, to an improved construction of holder adapted to hold tools with a round rod handle.

At the present time, the cleaning of house and the surroundings is an indispensable household chore. With elevated quality of living, the tools used for house-cleaning appear in great varieties to meet the needs of different occasions, such as brooms, swabs, brushes, etc. Faced with so many types of cleaning tools, it is quite a problem to have a proper place to keep them.

To overcome these shortcomings, the inventor of the present invention, with his experience of actual work and understanding of the needs, studied the conventional devices for improvement and finally developed the Double Circle Utility Holder for using by the consuming public.

The main purpose of this invention is to offer a solution to overcome the shortcomings of the conventional devices, by providing this Double-Circle Utility Holder. The device newly invented is composed of a holder body made of elastic material and provided with two clamp portions, one at the top and the other at the bottom of the holder, so that the two clamp portions can be bent together for the rod handle of the tool to pass through. When the bending force is released, the elasticity of the material will restore the holder to its original state and thus the rod handle of the tool is held by the clamp portions. In the meantime, the tool to be held firmly is to stay put through the friction generated at a large contact surface between by the rod handle and the clamp portions.

Another purpose of the present invention is to enable the holder to slide on a rail when several holders are used in a group, and to be nailed to a wooden plank or on a wall when used singularly.

With reference of the drawings one will appreciate the other objects, structure and functions of the present invention.

Figure 1:
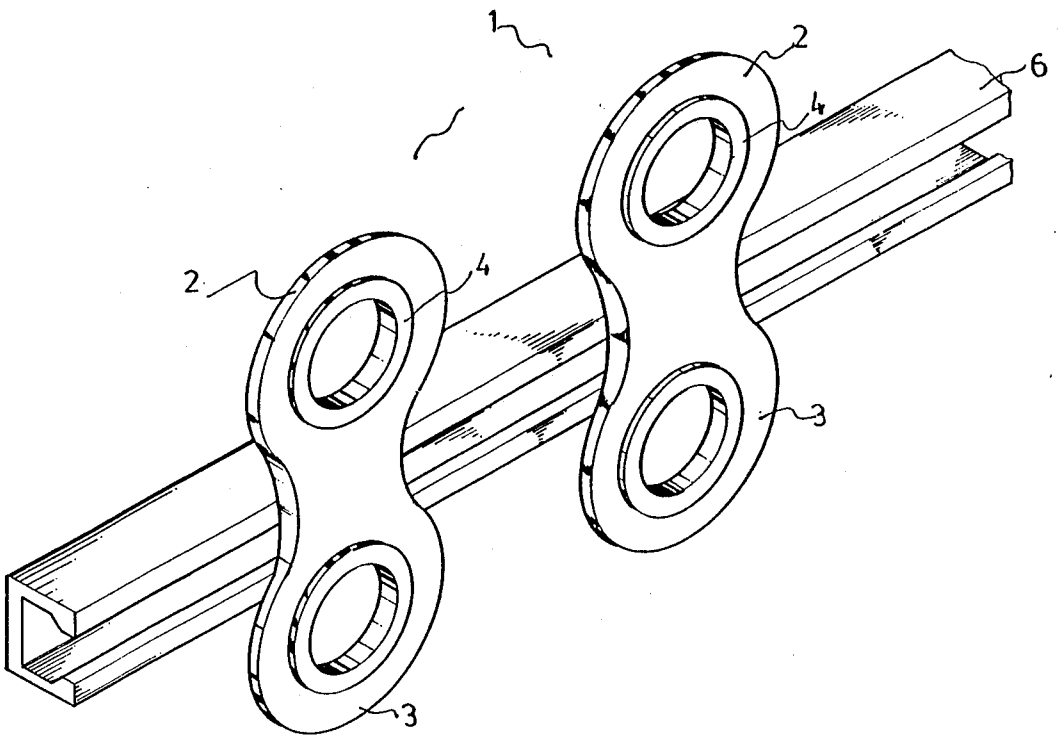
FIG. 1 is a perspective view of this invention.
Figure 2:
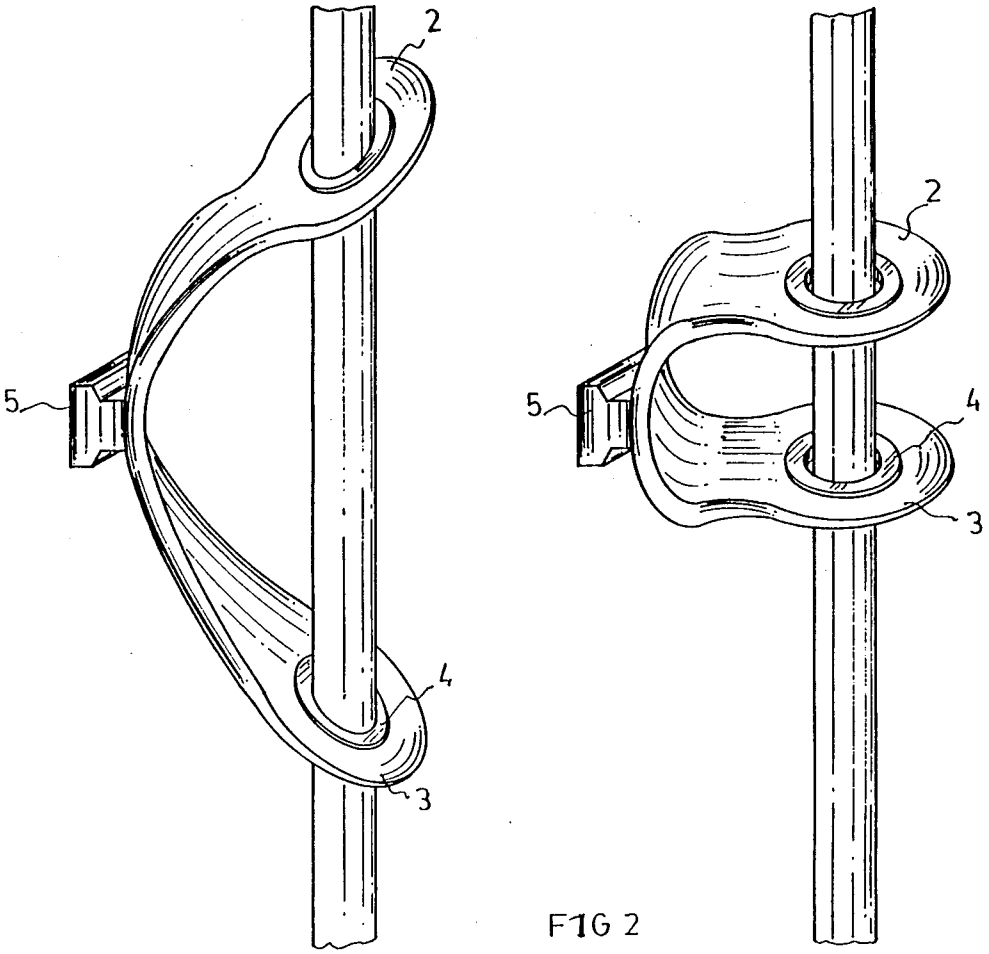
FIG. 2 shows the holder holding the rod handle of a tool.
Figure 3:
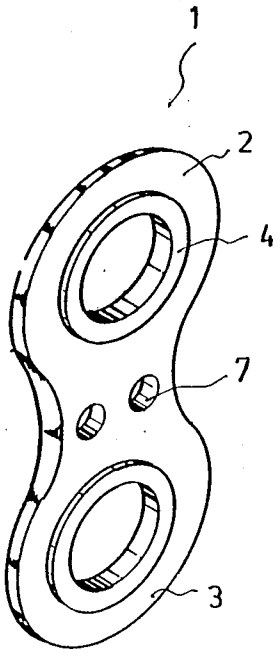
FIG. 3 is a schematic view showing the holder used singularly.

From the drawings, it can be seen that: The holder (1) devised under the present invention is made of elastic material and takes the shape of "8", with clamp portions (2) and (3) provided at the top and the bottom each being symmetrically disposed relative to the center of the holder body (1). The clamp portions (2) and (3) are each provided with a holding hole of the same size also symmetrically disposed about the center of the holder body (1). Clamp portions (2) and (3) are provided, with rubber washer (4) around the holding hole. The clamps (2) and (3), at the top and at the bottom of the elastic holder (1) are bent to press the clamp portions together and then the rod handle of the tool is to pass through the washer (4) around the holding holes of the clamp portions (2) and (3). When the pressure is released, the holder restores its original state and exercises a force on the rod handle of the tool to clamp the tool steadily by the strength of resiliency of the elastic materials of the holder. The washers (4) on the clamp portions (2) and (3) form a wide contact area with the rod handle of the tool, so that the friction force of washers (4) will tightly hold the rod handle of the tool, thus forming a double clamping. As a result, the working tool is securely held in place.

When the holder (1) is used singularly instead of a group, two through holes (7) are further provided in the central part of the holder (1) for nailing the holder (1) on a wooden plank or on a wall. The holder Body (1) may be provided with a slider (5) either attached thereto or formed integral therewith. By movably disposing the slider (5) into a rail (6) fixed on a wall, the holder body (1) can be positioned on the rail (6) and can be movable along the rail (6).

In summing up, the above is just one embodiment of the present invention and by no means intends to limit the invention thereto. Anyone skilled in the art can make variations, different applications, and conversion with equal effects are considered still within the scope of the present invention.

I claim:

1. A double-circle utility holder for holding a rigid rod-like article, comprising a holder body made of an elastic material, a slider attached to the holder body, and a rail for receiving the slider, said holder body having two clamp portions which are symmetrically disposed relative to the center of the holder body, each clamp portion having a holding hole, said holes being of the same size and symmetrically disposed relative to the center of said holder body, whereby the rigid rod-like article passed through the two holding holes can be held securely by the clamp portions by the elastic outward restoring force of the clamp portions.

2. The utility holder according to claim 1 wherein each holding hole is provided with an elastic washer.

3. The utility holder according to claim 1, wherein the holder body and the slider are formed integrally of an elastic material.

4. The utility holder according to claim 3 wherein each holding hole is provided with an elastic washer.

5. A double-circle utility holder for holding a rigid-rod-like article, comprising a holder body made of an elastic material and an attaching means provided adjacent to the center of the holder body; said holder body having two clamp portions which are symmetrically disposed relative to the center of the holder body, each clamp portion having a holding hole, said holes being of the same size and symmetrically disposed relative to the center of the holder body, whereby the rigid rod-like article passed through the two holding holes can be held securely by the clamp portions by the elastic outward restoring force of the clamp portions.

6. The utility holder according to claim 5 wherein each holding hole is provided with an elastic washer.

7. A double-circle utility holder for holding a rigid rod-like article, comprising a holder body which is made of an elastic material having one or more through holes adjacent to the center of the holder body; said holder body having two clamp portions which are symmetrically disposed relative to the center of the holder body, each clamp portion having a holding hole, said holes being of the same size and symmetrically disposed relative to the center of the holder body, whereby the rigid rod-like article passed through the two holding holes can be held securely by the clamp portions by the elastic outward restoring force of the clamp portions.

8. The utility holder according to claim 7 wherein each holding hole is provided with an elastic washer.

* * * * *